US008374755B2

(12) United States Patent
Lin et al.

(10) Patent No.: US 8,374,755 B2
(45) Date of Patent: Feb. 12, 2013

(54) MACHINE WITH TASK-DEPENDENT CONTROL

(75) Inventors: Hong-Chin Lin, Glenview, IL (US); Yun-Ren Ho, Naperville, IL (US); Lucas Adam Knapp, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 1286 days.

(21) Appl. No.: 11/882,234

(22) Filed: Jul. 31, 2007

(65) Prior Publication Data

US 2009/0037072 A1 Feb. 5, 2009

(51) Int. Cl.

| | |
|---|---|
| ***G06F 19/00*** | (2011.01) |
| ***G06G 7/70*** | (2006.01) |
| ***A01D 69/03*** | (2006.01) |
| ***A01B 61/00*** | (2006.01) |
| ***A01B 67/00*** | (2006.01) |
| ***F16D 31/00*** | (2006.01) |

(52) U.S. Cl. ..... 701/50; 701/58; 701/99; 340/439; 56/10.2 R; 172/2; 60/428; 60/445; 37/403; 37/405

(58) Field of Classification Search ..... 701/1, 29, 701/36, 50–58, 70, 99, 29.1; 340/438, 439, 340/441; 56/10.1, 10.2 R; 172/1–3, 9; 60/428, 60/431, 445; 37/403, 404, 405
See application file for complete search history.

(56) References Cited

U.S. PATENT DOCUMENTS

| | | | |
|---|---|---|---|
| 4,475,380 | A | 10/1984 | Colovas et al. |
| 4,697,418 | A | 10/1987 | Okabe et al. |
| 4,726,186 | A | 2/1988 | Tatsumi et al. |
| 4,904,161 | A | 2/1990 | Kamide et al. |
| 4,955,344 | A | 9/1990 | Tatsumi et al. |
| 5,077,973 | A | 1/1992 | Suzuki et al. |
| 5,214,916 | A | 6/1993 | Lukich |
| 5,406,483 | A | 4/1995 | Kallis et al. |
| 5,469,646 | A | 11/1995 | Takamura |
| 5,477,679 | A | 12/1995 | Tatsumi et al. |
| 5,481,875 | A | 1/1996 | Takamura et al. |
| 5,586,536 | A | 12/1996 | Seo et al. |
| 5,630,317 | A | 5/1997 | Takamura et al. |

(Continued)

FOREIGN PATENT DOCUMENTS

| | | |
|---|---|---|
| EP | 0612916 A2 | 8/1994 |
| EP | 0532756 B1 | 10/1996 |

(Continued)

OTHER PUBLICATIONS

International Search Report for PCT/US2008/002578, mailed Jun. 24, 2008.

(Continued)

*Primary Examiner* — Thomas Tarcza
*Assistant Examiner* — Edward Pipala
(74) *Attorney, Agent, or Firm* — Finnegan, Henderson, Farabow, Garrett & Dunner LLP

(57) ABSTRACT

A control system for a machine is disclosed. The control system may have a power source, an operator input device configured to generate a first signal indicative of a desired mode of power source operation, and a work implement driven by the power source. The control system may also have a controller in communication with the power source and the operator input device. The controller may be configured to classify a currently performed work implement task and select an output map based on the classification of the currently performed work implement task and the first signal. The controller may further be configured to control the power source operation using the output map.

20 Claims, 4 Drawing Sheets

U.S. PATENT DOCUMENTS

| | | | |
|---|---|---|---|
| 5,682,855 | A | 11/1997 | Lee et al. |
| 5,954,617 | A | 9/1999 | Horgan et al. |
| 5,983,156 | A | 11/1999 | Andrews |
| 6,042,505 | A | 3/2000 | Bellinger |
| 6,161,522 | A | 12/2000 | Fuchita et al. |
| 6,182,448 | B1 | 2/2001 | Ohkura et al. |
| 6,234,254 | B1 | 5/2001 | Dietz et al. |
| 6,336,067 | B1 | 1/2002 | Watanabe et al. |
| 6,371,885 | B1 | 4/2002 | Kobayashi et al. |
| 6,387,011 | B1 | 5/2002 | Bellinger |
| 6,436,005 | B1 | 8/2002 | Bellinger |
| 6,496,767 | B1 | 12/2002 | Lorentz |
| 6,546,329 | B2 | 4/2003 | Bellinger |
| 6,819,996 | B2 | 11/2004 | Graves et al. |
| 6,823,672 | B2 | 11/2004 | Nakamura |
| 6,944,532 | B2 | 9/2005 | Bellinger |
| 6,959,241 | B2 | 10/2005 | Itow et al. |
| 7,584,611 | B2 | 9/2009 | Ariga et al. |
| 2002/0017189 | A1 | 2/2002 | Nishimura et al. |
| 2002/0073699 | A1 | 6/2002 | Nishimura et al. |
| 2002/0132699 | A1 | 9/2002 | Bellinger |
| 2004/0002806 | A1 | 1/2004 | Bellinger |
| 2004/0088103 | A1 | 5/2004 | Itow et al. |
| 2004/0128047 | A1 | 7/2004 | Graves et al. |
| 2004/0148084 | A1 | 7/2004 | Minami |
| 2005/0149245 | A1 | 7/2005 | Kilworth et al. |
| 2006/0155453 | A1 | 7/2006 | Han et al. |
| 2006/0182636 | A1 | 8/2006 | Ivantysynova et al. |
| 2006/0235595 | A1 | 10/2006 | Sawada |
| 2007/0016355 | A1 | 1/2007 | Kamado et al. |
| 2007/0101708 | A1 | 5/2007 | Ohigashi |
| 2008/0006027 | A1 | 1/2008 | Ozawa et al. |
| 2008/0072588 | A1 | 3/2008 | Ariga et al. |
| 2008/0202468 | A1 | 8/2008 | Grill et al. |
| 2008/0319618 | A1 | 12/2008 | Sjogrem et al. |
| 2009/0240406 | A1 | 9/2009 | Fukushima et al. |

FOREIGN PATENT DOCUMENTS

| | | | |
|---|---|---|---|
| EP | 0667451 | B1 | 9/1997 |
| EP | 0795651 | | 9/1997 |
| EP | 0795651 | B1 | 5/2002 |
| EP | 1666711 | | 6/2006 |
| EP | 1803914 | | 7/2007 |
| JP | 62 160334 | | 7/1987 |
| JP | 07119506 | A | 5/1995 |
| WO | WO 98/06936 | | 2/1998 |
| WO | 2008106154 | | 9/2008 |

OTHER PUBLICATIONS http://www.transportandconstruction.co.za/articles/article6.html 5 pages, printed on Oct. 13, 2005.

http://www.komatsuamerica.com/index.cfm?resource_id=218, 3 pages, printed on Oct. 14, 2005.

Hitachi Construction and Mining Products Brochure, 1 page, printed on Oct. 14, 2005.

Komatsu WA600-6 Wheel Loader Product Brochure, 12 pages, Feb. 2006.

WA600-6 Wheel Loader Document, pp. 18-25, Sep. 23, 2005.

Outstanding Fuel Efficiency Document, 1 page.

U.S. Appl. No. 11/711,760, filed Feb. 8, 2007, "Machine System Having Task-Adjusted Economy Modes," pp. 1-18, Figs. 1-3.

Office Action for U.S. Appl. No. 11/711,760 mailed on Nov. 6, 2009 (13 pages).

MACHINE WITH TASK-DEPENDENT CONTROL

TECHNICAL FIELD

The present disclosure relates generally to a machine system and, more particularly, to control of a machine system power source based on classified tasks of the machine system's work implement.

BACKGROUND

Mobile machines, including wheel loaders, bulldozers, motor graders, and other types of heavy equipment, are used for a variety of operations. In order to accomplish these operations, the machines typically include a primary mover, such as an internal combustion engine. The primary mover is often coupled to traction devices to propel the machine and can also power a work implement attached to the machine.

Machines often have a "high-idle" mode of operation. During use of the high-idle mode of operation, an output of the primary mover is generally set to a level sufficient to quickly produce the maximum output to the traction devices and/or work implement. In other words, to ensure that the machine has power sufficient to move the machine and/or work implement under all conditions, the primary mover output (i.e., speed, torque, or a combination of speed and torque) is set at a high level, even if the current operation being performed by the machine demands less than the high output level. Although setting the primary mover output to a high level allows for immediately available power, it may be inefficient and result in excessive fuel consumption, exhaust emissions, and engine noise.

One way to control the output of a primary mover is disclosed in U.S. Pat. No. 4,697,418 (the '418 patent) issued to Okabe et al. on Oct. 6, 1987. The '418 patent relates to a control system for a hydraulic excavator. The excavator has a prime mover, a variable displacement hydraulic pump driven by the prime mover, at least one actuator driven by pressurized fluid from the pump, devices for sensing the operation condition of the actuators, and working elements associated with the actuators. The devices for sensing the operation condition of the actuators include a pressure switch for sensing whether travel motors are in operation and a pressure switch for sensing whether a boom cylinder, an arm cylinder, or a bucket cylinder for driving a front attachment and a swing motor for rotating a swing are in operation. The excavator also has a selection means for selecting an operation mode for each working element. The selection means includes a power mode (P-mode) suitable for heavy digging operations and an economy mode (E-mode) suitable for light digging operations.

Based on the output signals from the sensors and the selection means, the controller selects a combination of a prime mover maximum revolution number and a pump maximum displacement volume (e.g., the controller may select different prime mover and pump settings if digging in power mode versus digging in economy mode). The control means then sets the maximum revolution number of the prime mover and the maximum displacement volume of the hydraulic pump. Setting the prime mover maximum revolution number and pump maximum displacement volume according to the selection means and the operation condition of the actuators may help reduce fuel consumption and noise.

Although the construction machine of the '418 patent may improve fuel efficiency and noise by setting the prime mover maximum revolution number and the pump maximum displacement volume according to the selection means and the operation condition of the actuators, it may still be suboptimal. The control system of the '418 patent may only detect whether the actuators are in operation (i.e., on or off) rather than detecting what the actuators are accomplishing while in operation (i.e., raising the bucket, dumping material, digging, etc.). In other words, the control system of the '418 patent may respond to any operation that activates the pressure switch associated with the front attachments by setting the prime mover maximum revolution number and the pump maximum displacement volume at a level that may be either too high or too low for the actual task being performed. Furthermore, the control system of the '418 patent only controls the operation of the prime mover by setting the maximum revolution number, which may limit the ground speed and thus the productivity of the machine for certain tasks.

The disclosed machine system is directed to overcoming one or more of the problems set forth above.

SUMMARY OF THE INVENTION

In one aspect, the present disclosure is directed to a machine control system. The control system may include a power source, an operator input device configured to generate a first signal indicative of a desired mode of power source operation, and a work implement driven by the power source. The control system may also include a controller in communication with the power source and the operator input device. The controller may be configured to classify a currently performed work implement task and select an output map based on the classification of the currently performed work implement task and the first signal. The controller may further be configured to control the power source operation using the output map.

In another aspect, the present disclosure is directed to a method of operating a machine. The method may include receiving a user input indicative of a desired mode of power output generation, generating a power output, and directing the power output to actuate a work implement. The method may also include classifying a currently performed work implement task and selecting an output relationship based on the currently performed work implement task and the desired mode of power output generation. The method may further include adjusting the power output generation using the output relationship.

DETAILED DESCRIPTION

Figure 1:
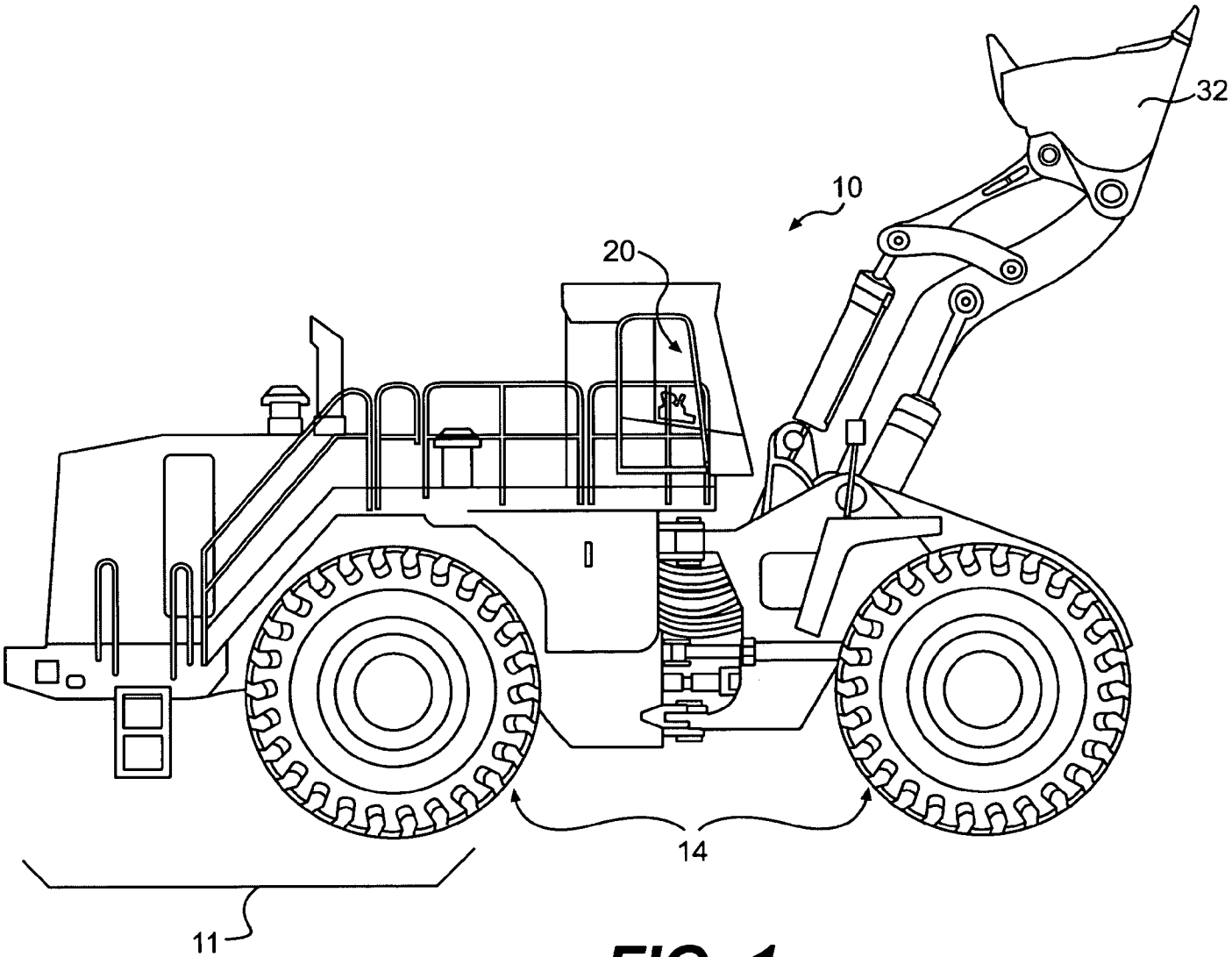
FIG. 1 is a diagrammatic illustration of an exemplary disclosed machine.
Figure 2:
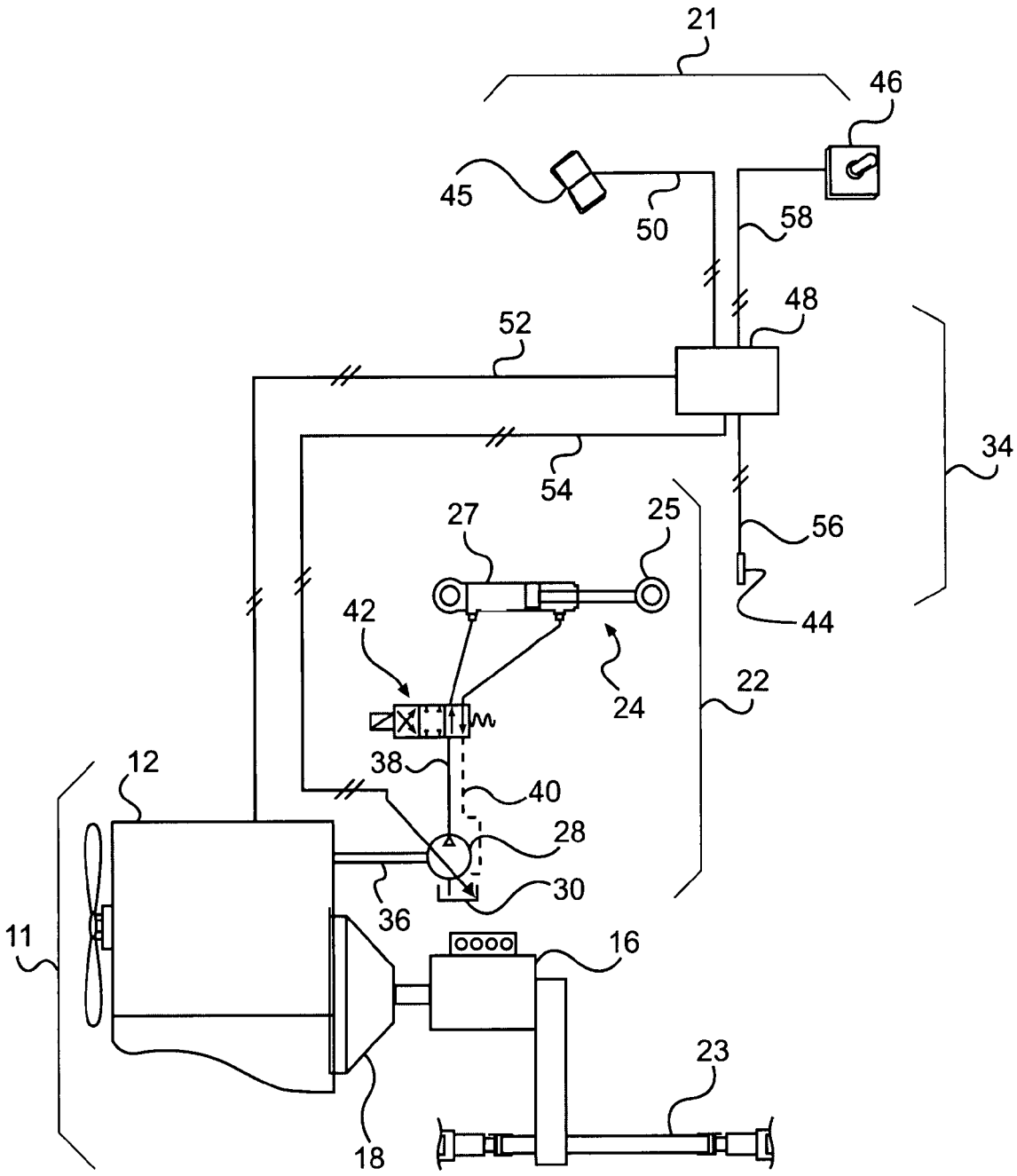
FIG. 2 is a schematic and diagrammatic illustration of an exemplary disclosed control system for use with the machine of FIG. 1.

FIG. 1 illustrates an exemplary embodiment of a machine 10. Machine 10 may be a mobile machine that performs some type of task or operation associated with an industry, such as mining, construction, farming, or any other industry known in the art. For example, machine 10 may be an earth moving machine, such as a wheel loader, an excavator, a backhoe, a motor grader, or any other suitable earth moving machine known in the art. Machine 10 may include a powertrain 11, at least one traction device 14, a work implement 32, and an operator station 20, As shown in FIG. 2, powertrain 11 may include a power source 12, a transmission 16, and a torque converter 18. These components may work together to propel machine 10. Power source 12 may embody an engine, such as a diesel engine, a gasoline engine, a gaseous fuel powered engine (e.g., a natural gas engine), or any other type of combustion engine known in the art. Power source 12 may alternatively embody a non-combustion source of power, such as a fuel cell, a power storage device, an electric motor, or other similar device. Power source 12 may be connected to drive traction device 14 (see FIG. 1), thereby propelling machine 10. Power source 12 may have a controllable output speed and torque.

Transmission 16 may transmit power from power source 12 to traction device 14. In particular, transmission 16 may embody a multi-speed, bidirectional, mechanical transmission a plurality of forward gear ratios, one or more reverse gear ratios, and one or more clutches (not shown). Transmission 16 may selectively actuate the clutches to engage predetermined combinations of gears (not shown) that produce a desired output gear ratio. Transmission 16 may be an automatic-type transmission, wherein shifting is based on a power source speed, a maximum operator selected gear ratio, and a shift map stored within a controller. Alternatively, transmission 16 may be a manual transmission, wherein the engaged gear is manually selected by an operator. Transmission 16 may connect to power source 12 by way of torque converter 18. An output of transmission 16 may rotatably drive traction device 14 via shaft 23, thereby propelling machine 10.

Referring again to FIG. 1, traction device 14 may convert a rotational motion provided by transmission 16 to a translational motion of machine 10. Traction device 14 may include wheels located on each side of machine 10. Alternately, traction device 14 may include tracks, belts, or other driven traction devices.

Work implement 32 may include any device used to perform a particular task, such as a bucket, a blade, a shovel, a ripper, or any other task-performing device known in the art. One or more work implements 32 may be attachable to a single machine 10 and controllable via operator station 20. Work implement 32 may be connected to machine 10 via a direct pivot, via a linkage system, via one or more hydraulic cylinders, via a motor, or in any other appropriate manner. Work implement 32 may pivot, rotate, slide, swing, lift, or move relative to machine 10 in any manner known in the art.

As further shown in FIG. 2, machine 10 may include a hydraulic system 22 and a control system 34. Hydraulic system 22, may include a plurality of components that cooperate to actuate work implement 32. Specifically, hydraulic system 22 may include one or more hydraulic cylinders 24, a pump 28, a tank 30, and a control valve 42. Fluid may be drawn from tank 30 by pump 28 to be pressurized. Once pressurized, the fluid may be metered by control valve 42 and supplied to hydraulic cylinder 24 or other components of machine 10 to perform useful work. Low pressure fluid may be returned to tank 30 to allow further use by pump 28. It is contemplated that hydraulic system 22 may include additional or different components, such as, for example, accumulators, check valves, pressure relief or makeup valves, pressure compensating elements, restrictive orifices, and other hydraulic components known in the art.

The axial displacement of hydraulic cylinder 24 may be effected by creating an imbalance of force on a piston assembly 25 disposed within a tube 27 of each hydraulic cylinder 24. Specifically, each hydraulic cylinder 24 may include a first chamber and a second chamber separated by piston assembly 25. Piston assembly 25 may include two opposing hydraulic surfaces, one associated with each of the first and second chambers. The first and second chambers may be selectively supplied with a pressurized fluid and drained of the pressurized fluid to create an imbalance of force on the two surfaces. The imbalance of force may cause piston assembly 25 to axially displace within tube 27.

Hydraulic cylinder 24 may be used to provide an actuating force for various components of machine 10, such as, for example, work implement 32. Work implement 32 may be connected to a frame of machine 10 via a direct pivot or a linkage system, with hydraulic cylinder 24 being a member of the pivot or linkage system. As hydraulic cylinder 24 axially displaces, the pivot or linkage system may translate or rotate, thus enabling the operator to perform a desired task with work implement 32. It is contemplated that several hydraulic cylinders 24 may be used in the pivot or linkage system to create additional degrees of freedom in the movement of work implement 32.

Pump 28 may produce a flow of pressurized fluid for use in machine 10. Pump 28 may embody a variable displacement pump, a fixed displacement pump, a variable flow pump, or any other source of pressurized fluid known in the art. Pump 28 may be drivably connected to power source 12 by, for example, a countershaft 36, a belt (not shown), an electric circuit (not shown), or in any other suitable manner. Although FIG. 2 illustrates pump 28 as being dedicated to supplying pressurized fluid only to hydraulic cylinder 24, it is contemplated that pump 28 may supply pressurized fluid to additional hydraulic components of machine 10.

Tank 30 may embody a reservoir configured to hold a supply of fluid. The fluid may include a hydraulic oil or any other hydraulic fluid known in the art. Pump 28 may draw fluid from and return fluid to tank 30. It is contemplated that pump 28 may be connected to multiple separate tanks 30.

Control valve 42 may meter fluid communicated between pump 28 and hydraulic cylinder 24. Control valve 42 may be connected to pump 28 via a supply line 38 and to tank 30 via a drain line 40. Control valve 42 may include at least one valve element that functions to meter pressurized fluid to one of the first and second chambers within hydraulic cylinder 24, and to simultaneously allow fluid from the other of the first and second chambers to drain to tank 30.

Control valve 42 may be pilot actuated against a spring bias to move between several positions. The positions may include a first position at which fluid is allowed to flow into the first chamber while fluid drains from the second chamber to tank 30, a second neutral position at which fluid flow is blocked from both the first and second chambers, and a third position at which the flow directions of the first position are reversed. The location of the valve element between the first, second, and third positions may determine a flow rate of the pressurized fluid into and out of the associated first and second chambers and a corresponding actuation velocity. It is contemplated that control valve 42 may alternatively be replaced with multiple independent metering valves that control the filling and draining functions of each of the first and second chambers for each hydraulic cylinder 24 separately. It is further contemplated that control valve 42 may alternatively be electrically actuated, mechanically actuated, or actuated in any other suitable manner.

Operator station 20 (see FIG. 1) may be a location from which the operator controls the operation of machine 10. Operator station 20 may be located on or off of machine 10 and may include one or more operator input devices 21, such as, for example, an operation mode selector 45 and a throttle lock selector 46. Operator input devices 21 may be located proximal an operator seat and may be associated with a console. Operator input devices 21 may embody single or multi-axis joysticks, wheels, knobs, push-pull devices, buttons, pedals, switches, and/or other operator input devices known in the art.

Operation mode selector 45 may be a device that receives input from an operator, indicative of a desired operation mode. In one embodiment, operation mode selector 45 may be a rocker switch with two selectable positions. Each position of the rocker switch may correspond to an operation mode, such as, for example, a normal and an economy mode. The normal mode may allow standard operation of machine 10. The economy mode may provide improved fuel efficiency, exhaust emissions, and engine noise through regulation of power source 12. It is contemplated that operation mode selector 45 may have any number of selectable positions with associated operation modes.

Throttle lock selector 46 may receive input from an operator indicative of a requested throttle setting for power source 12. Throttle lock selector 46 may include a means for activating or deactivating a throttle lock (e.g., on/off switch, button, or dial) and a means for inputting the requested throttle setting (not shown). The throttle setting means may embody a separate device (e.g., a separate pedal, dial, or electronic keypad) or may be integrated into the activating means (e.g., a single dial with a selectable off position and a range of "on" positions associated with the requested throttle setting for power source 12). When throttle lock selector 46 is activated, power source 12 may be maintained at a requested throttle setting. It is contemplated that the requested throttle setting of throttle lock selector 46 may be adjusted automatically in response to one or more inputs.

A control system 34 may monitor and modify the performance of machine 10 and its components. In particular, control system 34 may include a task sensor 44 and a controller 48. Controller 48 may communicate with power source 12 via communication line 52, operation mode selector 45 via communication line 50, throttle lock selector 46 via communication line 58, pump 28 via communication line 54, and task sensor 44 via communication line 56. It is contemplated that controller 48 may also communicate (not shown) with transmission 16, control valve 42, and/or other components of machine 10.

One or more task sensors 44 may provide information to controller 48 that may be used to classify a current task. Each task sensor 44 may embody, for example, a work implement position and/or velocity sensor, a machine travel speed sensor, a transmission gear ratio sensor, a power source speed sensor, an operator input device sensor, a pressure sensor associated with the pressurized fluid driving work implement 32, and any other sensor associated with the performance, operation, and/or productivity of machine 10. The type and number of sensors used may vary with the application. For example, a position and/or velocity task sensor may embody a potentiometer, a tachometer, or an optical encoder. A pressure task sensor may embody a piezoelectric transducer, a capacitive sensor, or a strain gauge. Controller 48 may use the information from one or more task sensors 44 in any combination to classify a currently performed task.

Controller 48 may embody a single microprocessor or multiple microprocessors that include a means for controlling an operation of machine 10. Numerous commercially available microprocessors may be configured to perform the functions of controller 48, and it should be appreciated that controller 48 may readily embody a general machine microprocessor capable of controlling numerous machine functions. Controller 48 may include a memory, a secondary storage device, a processor, and any other components for running an application. Various other circuits may be associated with controller 48, such as, for example, power supply circuitry, signal conditioning circuitry, data acquisition circuitry, signal output circuitry, signal amplification circuitry, and other types of circuitry known in the art.

Controller 48 may use any appropriate control algorithm, such as bang-bang control, proportional control, proportional integral derivative control, adaptive control, model-based control, logic-based control, or any other control method known in the art. Controller 48 may use open loop, feedforward, and/or feedback control.

It is considered that controller 48 may include one or more maps stored within an internal memory of controller 48. Each of these maps may include a collection of data in the form of tables, graphs, and/or equations. Specifically, controller 48 may include task maps that controller 48 may use to identify the currently performed task of work implement 32. Each task map may include preset ranges and/or specific values of data that relate to a pre-programmed work implement task. The data may include, for example, a work implement position, a work implement velocity, a machine travel speed, a transmission gear ratio, a power source speed, an operator input device position, a work implement fluid pressure, and/or any other machine related data known in the art (it is contemplated that the data may be machine dependent). The pre-programmed work implement tasks may include, a digging task, a traversing task, an unloading task, and other work implement tasks. Each pre-programmed work implement task may be a high power task or a low power task. For example, a digging task may be a high power task and an unloading task may be a low power task. It is contemplated that intermediate task levels may also be included (i.e., medium power task).

Controller 48 may include internal logic to compare the preset data within the task maps to the task sensor information and/or other simulated information. The internal logic may correlate the currently performed work implement task with one of the pre-programmed work implement tasks, thus classifying the currently performed work implement task as either a high power task or a low power task. It is contemplated that the preset ranges or values of data may be updated with the task sensor information or supplied by the operator.

Figure 3:
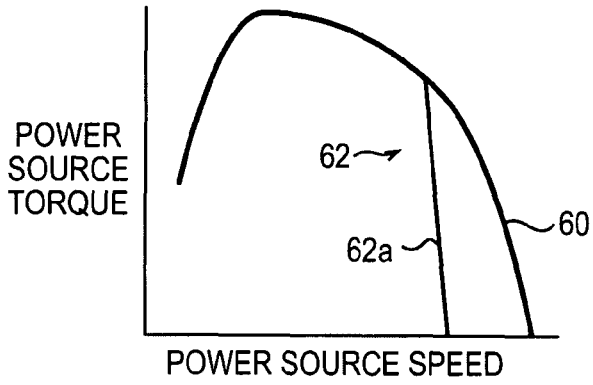
FIG. 3 is a graph of an exemplary output map.
Figure 4:
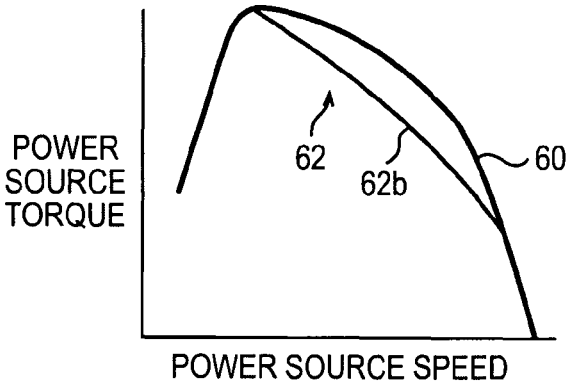
FIG. 4 is another graph of an exemplary output map.
Figure 5:
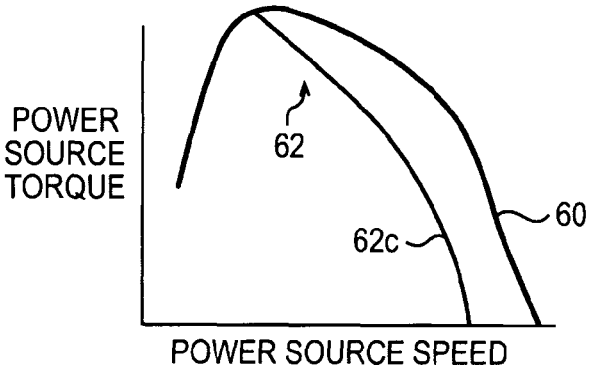
FIG. 5 is another graph of an exemplary output map.

As shown in FIGS. 3-5, controller 48 may also include one or more maps used for control of a power source output. The output maps may include a relationship between the power source speed (x-axis) and the power source torque (y-axis). The output maps may include a high power map 60 and a low power map 62. High power map 60 may correspond to a maximum range of power source torque and power source speed (the maximum range of power source torque and speed may be set by a governor or it may be set by physical limitations of machine 10). For low power map 62, at least one of the power source torque and power source speed may be limited from the maximum power source torque and/or power source speed as given by high power map 60. For example, as shown in FIG. 3, a speed limit map 62*a* may limit the available power source speed. In another example shown in FIG. 4, a torque limit map 62*b* may limit the available power source torque as a function of the available power source speed, however the maximum power source speed may still be achievable. In a final example shown in FIG. 5, a torque speed limit map 62*c* may limit the available power source speed and the available power source torque as a function of the available power source speed. It is contemplated that controller 48 may regulate the speed and/or torque of power source 12 by, for example, reducing and/or increasing a quantity of injected fuel, air inflow, pressure of the air inflow, power source timing, and/or valve timing of power source 12.

Controller 48 may select an output map based on the mode selection (e.g., normal or economy mode) and the classified work implement task (e.g., high power task or low power task). Controller 48 may select an output map in order to provide the necessary power required to achieve the currently performed work implement task, yet not create unnecessary fuel consumption. It is contemplated that the output map selected by controller 48 may modify a current throttle lock setting. It is also contemplated that the output map selected by controller 48 may modify the power available to hydraulic system 22. A relationship between the power source output and the power available to hydraulic system 22 may be included in the control logic in order ensure sufficient available power to operate work implement 32. It is contemplated that the displacement of pump 28 may be modulated by controller 48 to increase the available power for the operation of work implement 32. It is also contemplated that the displacement of pump 28 may be modulated to decrease the load on power source 12, and thus decrease fuel consumption.

INDUSTRIAL APPLICABILITY

The disclosed control system may be applicable to any machine where power source control is desired. Particularly, the disclosed control system may provide a plurality of selectable modes of operation, including at least one economy mode. Further, the disclosed control system may automatically adjust the power source output based on the selected mode of power source operation and the classification of low and high power tasks. This adjustment according to the current task may provide an overall reduction in fuel consumption, exhaust emissions, and engine noise. The operation of control system 34 will now be described.

Figure 6:
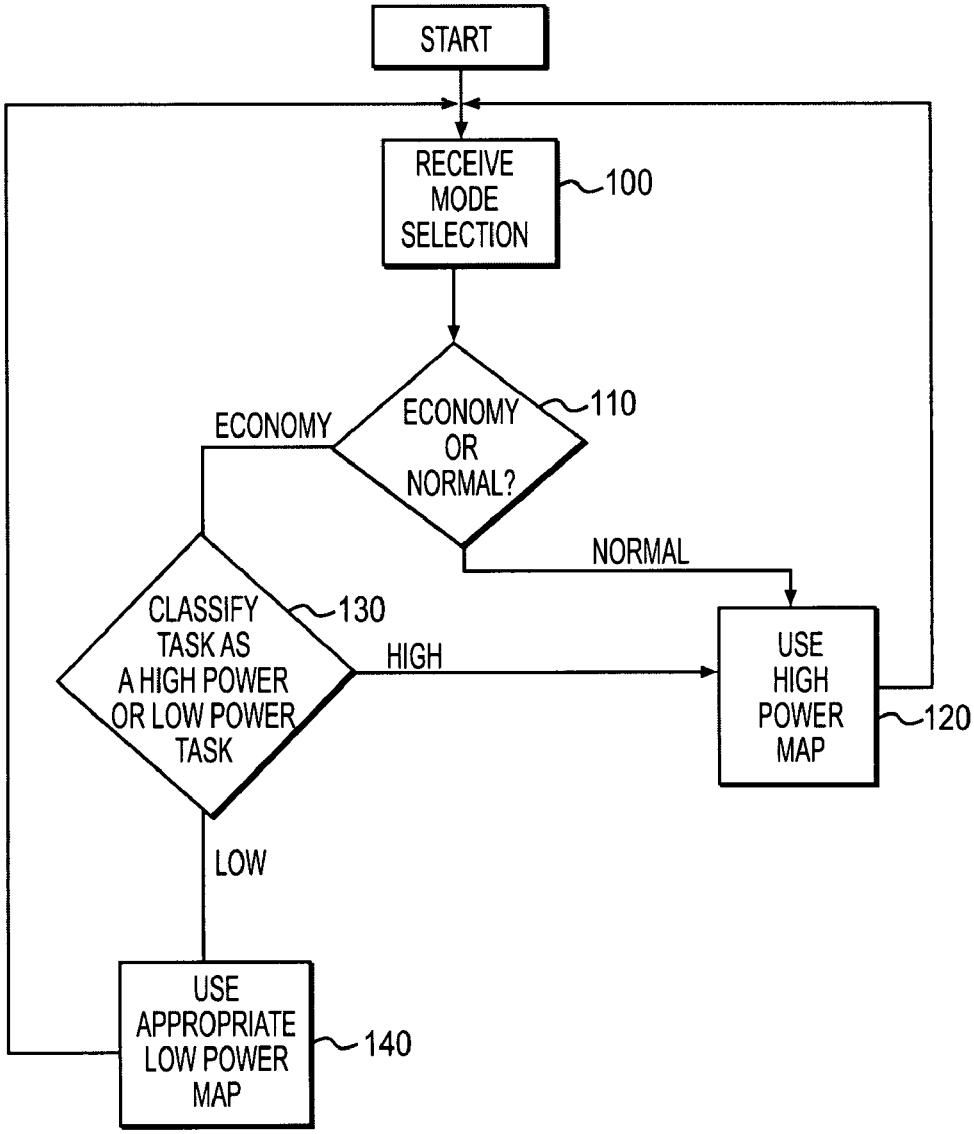
FIG. 6 is a flowchart depicting an exemplary operation of the control system illustrated in FIG. 2.

As shown in FIG. 6, the operator may (via operation mode selector 45) select between several available modes of machine operation (step 100). Upon receiving the mode selection, controller 48 may determine whether the operator has selected the economy mode or the normal mode of operation (step 110). When the operator selects the normal mode of operation, controller 48 may control power source 12 using high power map 60 (step 120). The operator may select the normal mode for tasks where economy may be sacrificed in return for responsiveness and/or capacity of machine 10. Controller 48 may remain in the normal mode until the operator selects a new mode of operation.

When the operator selects the economy mode of operation, controller 48 may communicate with task sensor 44 to receive information regarding the task currently being performed by machine 10. Controller 48 may then, according to the disclosed control algorithm, classify the currently performed work implement task as either a high power task or a low power task (step 130).

For example, machine 10 may be a wheel loader performing a loading cycle. This loading cycle may consist essentially of a digging task, a traversing task, and an unloading task. During the loading cycle, controller 48 may receive measurements from task sensor 44 regarding the work implement position, the work implement velocity, the machine travel speed, the transmission gear ratio, the power source speed and/or load, the operator input device position, and/or the work implement fluid pressure. Controller 48 may reference these measurements with the task maps stored in its memory to classify the currently performed work implement task. For example, a digging task may be identified when work implement 32 is in a lowered position, transmission 16 is in a low forward gear ratio, and power source 12 is loaded. Controller 48 may identify the digging task as a high power task and automatically respond by implementing high power map 60 (step 120). Controller 48 may continue to use high power map 60 until the wheel loader is no longer performing a high power task and/or controller 48 classifies the currently performed work implement task as a low power task, such as, for example, a traversing task or an unloading task (step 140).

Controller 48 may select a low power map 62 that efficiently achieves the classified work implement task. For example, a work implement task that requires high power source torque but only limited power source speed may be accomplished using speed limit map 62*a*. Alternatively, a work implement task that requires high power source speed (e.g., task requires high run-out speed) but only limited power source torque may be accomplished using torque limit map 62*b*. A work implement task that requires limited power source torque and power source speed may be accomplished using torque speed limit map 62*c*.

Several advantages of the disclosed control system may be realized. In particular, the disclosed system may provide a plurality of selectable modes of machine operation and automatically modulate the power source output when a task requires high power operation. The combination of selectable modes of operation and automatic task adjustments, may provide increased efficiency without added operator input complexity. The disclosed system may also selectively control the power source torque and speed based on the currently performed task to enhance machine efficiency without substantially decreasing productivity.

It will be apparent to those skilled in the art that various modifications and variations can be made to the disclosed task-adjusted economy mode system without departing from the scope of the invention. Other embodiments of the machine control system will be apparent to those skilled in the art from consideration of the specification and practice of the machine control system disclosed herein. It is intended that the specification and examples be considered as exemplary only, with a true scope being indicated by the following claims and their equivalents.

What is claimed is:

1. A machine control system, comprising:

a power source;

an operation mode selector having a first mode of power source operation and a second mode of power source operation selectable by an operator, the operation mode selector configured to generate a first signal indicative of the selected mode of power source operation;

a work implement driven by the power source; and a controller in communication with the power source and the operation mode selector, the controller being configured to:

classify a currently performed work implement task;

select an output map based on the classification of the currently performed work implement task and the first signal indicative of the selected mode of power source operation, the output map including a relationship between an available power source speed and an available power source torque; and control the power source operation using the output map.

2. The machine of claim 1, wherein the output map is selected from a plurality of output maps, the plurality of output maps including a high power map and a low power map.

3. The machine of claim 2, wherein the relationship for the low power map involves limiting at least one of:

the available power source speed;

the available power source torque as a function of the available power source speed; or the available power source speed and the available power source torque as a function of the available power source speed.

4. The machine of claim 3, wherein the the first mode is a normal mode and the second mode is an economy mode.

5. The machine of claim 4, further including:

a plurality of task classifications stored in the memory of the controller; and one or more task sensors, each task sensor being configured to generate a second signal indicative of one of a work implement position, a machine travel speed, a power source speed, or a transmission gear ratio, wherein the controller is in communication with the one or more task sensors and configured to identify the currently performed task using the plurality of task classifications and the second signal.

6. The machine of claim 5, further including:

a traction device;

a transmission to operatively connect the power source to the traction device; and a pump driven by the power source to pressurize fluid directed to drive the work implement.

7. A method of machine control, comprising:

receiving a user selection of at least one of a first mode or a second mode of power output generation;

generating a power output;

directing the power output to actuate a work implement;

classifying a currently performed work implement task;

selecting an output relationship based on the currently performed work implement task and the selected mode of power output generation, the output relationship relating an available power output speed and an available power output torque; and adjusting the power output generation using the output relationship.

8. The method of claim 7, wherein the output relationship is selected from a plurality of output relationships, wherein the plurality of output relationships includes a high power relationship and a low power relationship.

9. The method of claim 8, wherein the low power relationship involves limiting at least one of:

the available power output speed;

the available power output torque as a function of power output speed; or the available power output speed and the available power output torque as a function of power output speed.

10. The method of claim 9, wherein limiting involves modifying a throttle lock setting and an amount of fuel used for generating the power output.

11. The method of claim 9, wherein the first mode is a normal mode and the second mode is an economy mode.

12. The method of claim 11, further including generating a signal indicative of at least one of a work implement position, a work implement velocity, or the power output speed, wherein the signal is used for classifying the currently performed work implement task.

13. The method of claim 12, wherein selecting involves selecting a high power relationship when:

the currently performed work implement task is classified as a high power task; and the currently selected mode of power source operation is the economy mode.

14. The method of claim 13, wherein the high power task is a digging task.

15. The method of claim 12, wherein selecting involves selecting the low power relationship when:

the currently performed task is classified as a low power task; and the currently selected mode of power output generation is the economy mode.

16. The method of claim 15, wherein the low power task is at least one of an unloading task or a traversing task.

17. The method of claim 11, wherein the controller is configured to select the high power relationship when the currently selected mode of power output generation is the normal mode.

18. A control system for a mobile construction machine, comprising:

an operation mode selector having a first mode of power source operation and a second mode of power source operation selectable by an operator, the operation mode selector configured to generate a first signal indicative of the selected mode of power source operation;

a controller in communication with a power source and the operation mode selector, the controller including a high power output map and a low power output map, wherein each of the high power output map and the low power output map includes a relationship between an available power source speed and an available power source torque, the controller being configured to:

determine if the first mode or the second mode has been selected;

if the first mode has been selected, control the power source according to the high power output map;

if the second mode has been selected, the controller being further configured to:

classify a task currently performed by a work implement;

select one of the high power output map or the low power output map based on the classification of the currently performed work implement task; and control the power source operation using the one of the high power output map or the lower power output map.

19. The control system of claim 18, wherein the first mode is a normal mode and the second mode is an economy mode.

20. The machine control system of claim 19, wherein the operation mode selector comprises at least one of a switch or a button.

* * * * *